US011098384B2

(12) United States Patent
Hasegawa et al.

(10) Patent No.: US 11,098,384 B2
(45) Date of Patent: Aug. 24, 2021

(54) SULFUR ADDITIVE FOR MOLTEN STEEL AND METHOD FOR PRODUCING RESULFURIZED STEEL

(71) Applicant: NIPPON STEEL CORPORATION, Tokyo (JP)

(72) Inventors: Hajime Hasegawa, Tokyo (JP); Susumu Kudo, Tokyo (JP); Mitsuhiro Matsushima, Tokyo (JP); Tetsuro Sekiuchi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 217 days.

(21) Appl. No.: 16/346,060

(22) PCT Filed: Jun. 13, 2017

(86) PCT No.: PCT/JP2017/021869

§ 371 (c)(1),
(2) Date: Apr. 29, 2019

(87) PCT Pub. No.: WO2018/087953

PCT Pub. Date: May 17, 2018

(65) Prior Publication Data

US 2019/0292613 A1 Sep. 26, 2019

(30) Foreign Application Priority Data

Nov. 10, 2016 (JP) ..... JP2016-219986

(51) Int. Cl.

| | |
|---|---|
| ***C21C 7/00*** | (2006.01) |
| ***C22C 38/54*** | (2006.01) |
| ***C22C 38/50*** | (2006.01) |
| ***C22C 38/48*** | (2006.01) |
| ***C22C 38/24*** | (2006.01) |
| ***C22C 38/44*** | (2006.01) |
| ***C22C 38/42*** | (2006.01) |
| ***C22C 38/06*** | (2006.01) |
| ***C22C 38/58*** | (2006.01) |
| ***C22C 38/00*** | (2006.01) |
| ***C22C 38/60*** | (2006.01) |

(52) U.S. Cl.

CPC ..... *C21C 7/00* (2013.01); *C22C 38/00* (2013.01); *C22C 38/001* (2013.01); *C22C 38/002* (2013.01); *C22C 38/06* (2013.01); *C22C 38/24* (2013.01); *C22C 38/42* (2013.01); *C22C 38/44* (2013.01); *C22C 38/48* (2013.01); *C22C 38/50* (2013.01); *C22C 38/54* (2013.01); *C22C 38/58* (2013.01); *C22C 38/60* (2013.01)

(58) Field of Classification Search

CPC ..... C21C 7/00; C21C 7/0037; C21C 7/10; C22C 38/00; C22C 38/001; C22C 38/002; C22C 38/06; C22C 38/24; C22C 38/42; C22C 38/44; C22C 38/48; C22C 38/50; C22C 38/54; C22C 38/58; C22C 38/60

See application file for complete search history.

(56) References Cited

U.S. PATENT DOCUMENTS

| | | | |
|---|---|---|---|
| 2011/0017018 | A1 | 1/2011 | Poulalion et al. |
| 2015/0191807 | A1 | 7/2015 | Hanlon et al. |

FOREIGN PATENT DOCUMENTS

| | | | | |
|---|---|---|---|---|
| CN | 101280397 | A | | 10/2008 |
| CN | 101643815 | A | * | 2/2010 |
| JP | 10-102119 | A | | 4/1998 |
| JP | 2014-234543 | A | | 4/1998 |
| JP | 2000-87128 | A | | 3/2000 |
| KR | 10-2015-0040814 | A | | 4/2015 |
| KR | 10-2015-0057063 | A | | 5/2015 |
| RU | 2127323 | C1 | | 3/1999 |

OTHER PUBLICATIONS

International Preliminary Report on Patentability and Written Opinion of the International Searching Authority(Forms PCT/IB/326, PCT/IB/373 and PCT/ISA/237), dated May 23, 2019, for International Application No. PCT/JP2017/021869, with an English Translation of the Written Opinion.

International Search Report, dated Jul. 11, 2017, for International Application No. PCT/JP2017/021869, with an English translation.

"Handbook for Mineral Processing Engineers," Mineral Processing Industry Practices, vol. 3, Mar. 2015, pp. 308-809.

Chinese Office Action and Search Report for Chinese Application No. 201780056862.8, dated Nov. 9, 2020, with English translation of the Office Action.

* cited by examiner

*Primary Examiner* — Jenny R Wu

(74) *Attorney, Agent, or Firm* — Birch, Stewart, Kolasch & Birch, LLP

(57) ABSTRACT

A sulfur additive is added to molten steel. At that time, the yield of sulfur in the molten steel is stabilized and nozzle blockage at the time of continuous casting due to impurities is prevented. A sulfur additive used for molten steel which contains iron sulfide ore particles with a particle size of 5.0 to 37.5 mm in 85 mass % or more with respect to the total mass % of the sulfur additive is used to produce Al deoxidized resulfurized steel containing S: 0.012 to 0.100 mass %.

3 Claims, 1 Drawing Sheet

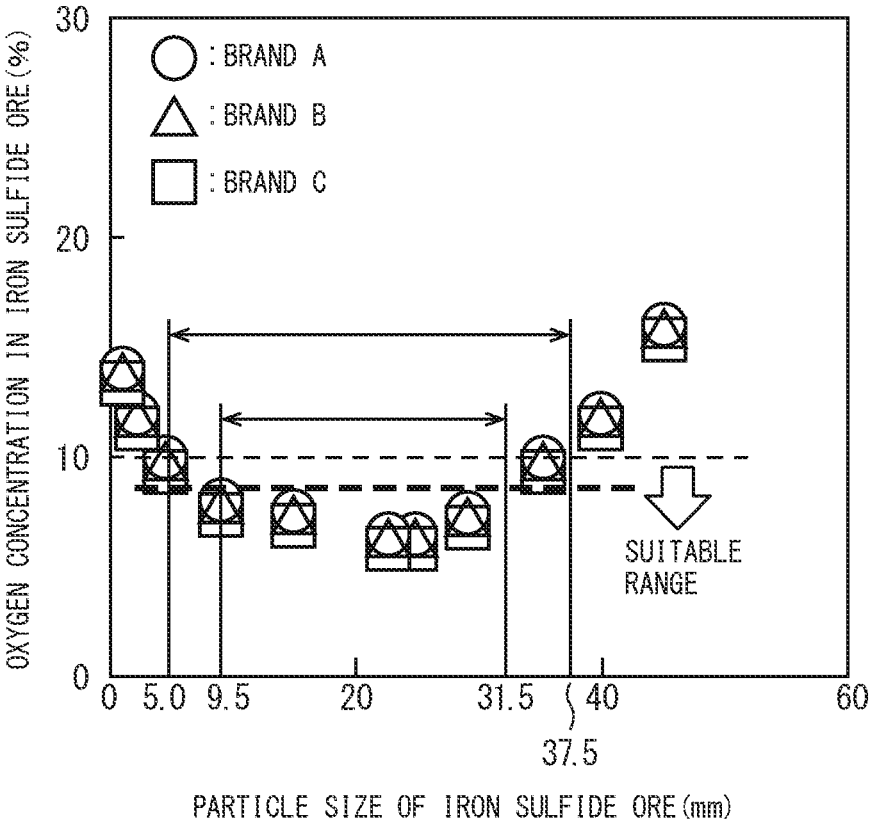
30
20
10
0
OXYGEN CONCENTRATION IN IRON SULFIDE ORE(%)
: BRAND A
: BRAND B
: BRAND C
SUITABLE RANGE
0
5.0
9.5
20
31.5
40
60
37.5
PARTICLE SIZE OF IRON SULFIDE ORE(mm)

SULFUR ADDITIVE FOR MOLTEN STEEL AND METHOD FOR PRODUCING RESULFURIZED STEEL

FIELD

The present invention relates to a sulfur additive to be added to molten steel for adjusting the constituents of the molten steel and to a method for producing the resulfurized steel using that sulfur additive.

BACKGROUND

Sulfur (S) is an element improving the machineability of steel materials, so is often added in required amounts in the steelmaking process to molten steel of particularly steel for machine structure use which is machined into complicated shapes. At this time, as a sulfur additive, pure sulfur refined to a high purity, industrially produced iron sulfide, or pyrite, marcasite, pyrrhotite, etc. obtained by various beneficiation methods are used.

These sulfur additives are manufactured through industrial processes, so inevitably become higher in price. As opposed to this, recently, as a more inexpensive sulfur additive, the practice of using directly iron sulfide ore obtained from mines as is has been introduced.

In this regard, the molten steel refined in converters or vacuum vessels contains a large amount of oxygen. Removal of this large amount of oxygen by adding 0.015 to 0.100% or so by mass of Al, which is a deoxidizing element having a strong affinity with oxygen, is a general practice.

However, deoxidation by Al produces $Al_2O_3$-based inclusions. These aggregate to produce coarse alumina clusters. Such alumina clusters deposit on the inside wall of the continuous casting nozzles which is used for injecting molten steel from the tundish to the mold (including sliding nozzles and other injection adjusting nozzles and submerged nozzles), and therefore, cause the phenomenon of these nozzles being blocked at the time of continuous casting (below, also referred to as "nozzle blockage").

In particular, when using iron sulfide ore as it is as a sulfur additive for molten steel, the impurities in the iron sulfide ore (oxides, carbonates, etc.) become oxygen sources resulting in the formation of a larger number of alumina clusters, and therefore, cause more easily nozzle blockage.

To deal with such an issue of intermixture of oxygen sources from the additives or added alloy elements into the molten steel, PTL 1 proposes a secondary refining method of molten steel which comprises the step of using a vacuum degasification apparatus to decarburize and deoxidize the molten steel and adding alloy elements to the molten steel, wherein the alloy elements are added during the decarburization process of the molten steel, and then the deoxidation process is carried out.

However, when adding a sulfur additive to molten steel, desulfurization proceeds by virtue of the reaction between the molten steel and ladle slag, and therefore, when adding a sulfur additive to molten steel at an early stage, the yield of sulfur in the molten steel does not become stable and it is difficult to stably secure the desired composition of sulfur in the obtained resulfurized steel.

CITATION LIST

Patent Literature

[PTL 1] Japanese Unexamined Patent Publication No. 2000-087128

SUMMARY

Technical Problem

In consideration of the current problem in the prior art, the technical problem which the present invention is intended to solve is to stabilize the yield of sulfur in molten steel when adding a sulfur additive to molten steel and to prevent the occurrence of nozzle blockage by virtue of impurities at the time of continuous casting. Specifically, the present invention has the object thereof to provide a sulfur additive which is inexpensive and has few impurities and to provide a method for producing resulfurized steel using that sulfur additive.

Solution to Problem

The inventors studied in-depth techniques for solving the above technical problem. As a result, they discovered that if using iron sulfide ore having a specific particle size obtained by crushing and sieving as a sulfur additive, it is possible to stabilize the yield of sulfur in the molten steel and prevent occurrence of nozzle blockage at the time of continuous casting.

The present invention was made based on the above discovery and has as its gist the following:

(1) A sulfur additive used for molten steel, wherein the sulfur additive contains iron sulfide ore particles having a particle size of 5.0 to 37.5 mm of 85% or more by mass % based on the total mass % thereof.

(2) The sulfur additive for molten steel according to (1), wherein the particle size is between 9.5 and 31.5 mm.

(3) A method for producing resulfurized steel comprising a sulfur adding step of adding the sulfur additive according to (1) or (2) to Al-deoxidized molten steel, wherein the method for producing the resulfurized steel smelts resulfurized steel comprising, by mass %, C: 0.07 to 1.20%,
Si: over 0 to 1.00%,
Mn: over 0 to 2.50%,
N: over 0 to 0.02%
S: 0.012 to 0.100%, and
Al: 0.015 to 0.100,
P: limited to 0.10% or less, and
a balance of iron and unavoidable impurities.

(4) The method for producing resulfurized steel according to (3), wherein the resulfurized steel further contains, by mass %, one or more elements selected from Cu: 2.00% or less,
Ni: 2.00% or less,
Cr: 2.00% or less,
Mo: 2.00% or less,
Nb: 0.25% or less,
V: 0.25% or less,
Ti: 0.30% or less, and
B: 0.005% or less.

Advantageous Effects of Invention

According to the present invention, it is possible to provide a sulfur additive which is inexpensive and has few impurities, and it is possible to provide a method for producing resulfurized steel which stabilize the yield of the sulfur in the molten steel during the sulfur additive being added to the molten steel and prevents occurrence of nozzle blockage at the time of continuous casting.

BRIEF DESCRIPTION OF DRAWINGS

FIG. 1 is a view showing the relationships between the particle sizes (mm) of iron sulfide ore particles of brands A, B, and C of iron sulfide ore used as a sulfur additive and the oxygen concentrations in the iron sulfide ore particles (%).

DESCRIPTION OF EMBODIMENTS

The sulfur additive according to the present invention used for molten steel (below, sometimes referred to as "the additive according to the present invention") is characterized by containing iron sulfide ore having a particle size of 5.0 to 37.5 mm of 85% or more by mass % based on the total mass % thereof.

The method for producing the resulfurized steel according to the present invention (below, sometimes referred to as "the method for producing according to the present invention") is characterized by using the additive according to the present invention to produce Al-deoxidized resulfurized steel containing Al: 0.015 to 0.100 mass % and S: 0.012 to 0.100 mass %.

Further, in the method for producing according to the present invention, it is preferable to add the additive according to the present invention in the RH vacuum degassing process after adjusting the constituents other than the sulfur.

Below, the background from the conception of the invention to the completion of the invention and the additive according to the present invention and the method for producing according to the present invention will be explained.

The inventors investigated in detail the composition and characteristics of iron sulfide ore rock so as to enable inexpensive iron sulfide ore to be used as a sulfur additive.

First, the inventors investigated the composition of iron sulfide ore by chemical analysis and X-ray diffraction. As a result, they have found that although the main constituent in iron sulfide ore is pyrite the iron sulfide ore contains dolomite, quartz, and other carbonates and oxides in addition to pyrite. The inventors have found that these impurities (dolomite, quartz, and other carbonates and oxides, below sometimes simply referred to as "impurities") are included in the iron sulfide ore in a range of from 3 to 20 mass % or so in terms of oxygen concentration.

Next, the inventors investigated the form of these impurities. They sliced the iron sulfide ore and examined the cross-section using an optical microscope or scan electron microscope (SEM) etc. As a result, the inventors have found that (a) the impurities are present in iron sulfide ore as aggregates of fine particles of particle sizes of several millimeters or less and that (b) the impurities are not present uniformly in the iron sulfide ore but are segregated therein. Further, they similarly examined a plurality of types of iron sulfide ore with different particle sizes, and as a result, they have found that (c) there are differences in the states of distribution of the impurities among the types of iron sulfide ore particles.

The inventors, based on the results, thought that "the amounts of impurities contained in the iron sulfide ore might differ depending on the particle sizes of the iron sulfide ore". On the basis of that technical concept, they separated the iron sulfide ore particles by size by sieving and measured the amounts of impurities (mass converted to oxygen concentration) for each particle size of iron sulfide ore by virtue of usual chemical analysis, X-ray diffraction, etc.

FIG. 1 shows, as examples, the relationships between the particle sizes (mm) of iron sulfide ore obtained by crushing three types of actual brands A, B, and C of iron sulfide ore rock differing in production areas and separating them into multiple sizes by sieving and the oxygen concentration in the iron sulfide ore for each particle size (mass %). The oxygen concentration in the iron sulfide ore was measured by way of inert gas fusion-infrared absorption spectrum that is one type of chemical analysis. As will be understood from FIG. 1, although the production areas differ, the relationships between the particle size and oxygen concentration are substantially the same. The oxygen concentration became low in the range of particle size of 5.0 to 37.5 mm, more preferably in the range of particle size of 9.5 to 31.5 mm.

Further, from FIG. 1, it is clear that when the particle size of the iron sulfide ore is 5.0 to 37.5 mm in range, the concentration of oxygen contained in the iron sulfide ore is small (oxygen concentration of 10 mass % or less) and further that when the particle size is 9.5 to 31.5 mm in range, the oxygen concentration is further smaller (oxygen concentration of 9 mass % or less). On this point as well, similar results were obtained for all of the three types of brands A, B, and C. From the results, it is expected that even if blending the different brands and similarly analyzing them, in the same way as the case of single brands, if the particle size is 5.0 to 37.5 mm in range, more preferably if the particle size is 9.5 to 31.5 mm in range, the oxygen concentration will become low in level.

The reason why such results were obtained is believed to be as follows:

The iron sulfide ore produced from mines unavoidably contains carbonates, oxides, and other impurities. The sizes of these particles are small ones of several millimeters or less. Further, the main constituent of iron sulfide ore, pyrite, and these impurities greatly differ in hardness. Usually, iron sulfide ores are crushed using a crusher etc. so as to be made to be easily handled, but the fracture of the iron sulfide ores is believed to occur starting from the interfaces of the pyrite and impurities which are different in hardness.

Furthermore, at the time of crushing, fine impurity particles are finely dispersed. It is believed that it is hard for impurities to remain in relatively coarse (5.0 to 37.5 mm) iron sulfide ore particles, while a relatively large amount of impurities remain in fine iron sulfide ore particles of less than 5.0 mm size. Note that, in coarse (over 37.5 mm) iron sulfide ore, impurity particles are believed to remain as they are without being crushed.

Based on the results of the above investigations, it was decided to use iron sulfide ore particles with a particle size of 5.0 to 37.5 mm, preferably iron sulfide ore particles with a particle size of 9.5 to 31.5 mm, as a sulfur additive to be added to molten steel.

Usually, raw ore of iron sulfide ore is crushed and sieved to obtain iron sulfide ore with a particle size of 5.0 to 37.5 mm. However, the iron sulfide ore with a particle size of 5.0 to 37.5 mm in range is directly used as it is even without crushing. Particles with a particle size as a result of sieving of over 37.5 mm may be again crushed to a particle size of 5.0 to 37.5 mm in range. The same method as this one is applied to iron sulfide ore particles with a particle size of 9.5 to 31.5 mm.

For the sulfur additive to be added to molten steel, one containing iron sulfide ore particles with a particle size of 5.0 to 37.5 mm, preferably iron sulfide ore particles with a particle size of 9.5 to 31.5 mm, in a mass % of 85% mass or more is used.

When iron sulfide ore particles with a particle size of 5.0 to 37.5 mm are contained in the sulfur additive in less than 85 mass %, it becomes difficult to suitably adjust the amount of sulfur in the molten steel to the required range. Therefore, the amount of the iron sulfide ore particles with a particle size of 5.0 to 37.5 mm is made to be 85% or more by mass based on the total amount of the sulfur additive, preferably 90 mass % or more.

Note that, the particle size of the iron sulfide ore particles is measured after sieving the iron sulfide ore by the method prescribed in JIS Z 8815 (ISO2591-1). The iron sulfide ore passing through a test sieve of metal wire cloth with nominal openings of 37.5 mm prescribed in JIS Z 8801-1 (ISO3310-1) and remaining on a test sieve of metal wire cloth with nominal openings of 5.0 mm is defined as iron sulfide ore particles with a particle size of 5.0 to 37.5 mm.

The inventors added iron sulfide ore particles to molten steel and investigated the changes in oxygen concentration in the molten steel so as to confirm the effects of the additive according to the present invention. A rise in the oxygen concentration in the molten steel was seen after adding iron sulfide ore into the molten metal. However, it could be confirmed that the amount of change was small with addition of iron sulfide ore particles with a particle size of 5.0 to 37.5 mm in range and, further, was smaller with addition of iron sulfide ore particles with a particle size of 9.5 to 31.5 mm in range.

Next, the method for producing resulfurized steel according to the present invention will be explained.

The chemical composition of molten steel obtained by primary refining in a converter or electrical furnace etc. is adjusted. If necessary, secondary refining is carried out by an RH vacuum degassing apparatus, ladle-heating type refining apparatus, simplified molten steel processing apparatus, etc. After the primary refining or during the secondary refining, deoxidation is carried out by addition of Al. When conducting deoxidation after primary refining, it is sufficient to add the Al source at the time of tapping into the laddle. When conducting deoxidation during secondary refining, the yield of Al stabilizes by virtue of removing the ladle slag at the position where the Al source is to be added.

Note that, the Al source is preferably added to the molten steel at as early a stage as possible after primary refining, then the molten steel stirred and the $Al_2O_3$ inclusions floating up separated.

In the method for producing according to the present invention, after the Al deoxidation process of deoxidizing the molten steel by adding Al thereinto, the additive according to the present invention (iron sulfide ore with a particle size of 5.0 to 37.5 mm in 85 mass % or more) is added to the Al-deoxidized molten steel at the end stage of the secondary refining wherein the adjustment of the chemical composition of the molten steel has been finished. Note that, when adding the additive according to the present invention before the secondary refining or in the first half of the secondary refining, the additive will react with the ladle slag resulting in advancing desulfurization and it is liable to become impossible to control the sulfur concentration in the obtained resulfurized steel to a required range.

In this way, by virtue of adding the additive according to the present invention to the Al deoxidized molten steel in the end stage of the secondary refining, it becomes harder for the $Al_2O_3$ inclusions produced from the oxygen present in the impurities of the iron sulfide ore particles to float up and separate, and the occurrence of nozzle blockage at the time of continuous casting is suppressed. Further, the yield of sulfur in the molten steel also becomes stable.

The thus prepared molten steel is continuously cast into slabs in accordance with an ordinary method. At the time of continuous casting, oxygen sources should be prevented from being mixed into the molten steel. If oxygen sources are mixed into the molten steel, $Al_2O_3$ inclusions are formed, therefore, this is for preventing formation of $Al_2O_3$ inclusions.

Note that, the submerged nozzle used at the time of continuous casting may be one of an inexpensive alumina graphite material, but a nonstick nozzle containing CaO may also be used.

The method for producing according to the present invention is suitable for manufacturing resulfurized steel containing S: 0.012 to 0.100 mass %. The resulfurized steel obtained by the method for producing according to the present invention contains Al: 0.015 to 0.100 mass % after Al deoxidation.

Below, the reasons for limitation of the chemical composition of the resulfurized steel produced by the method for producing according to the present invention (below, sometimes referred to as "the added steel according to the present invention") will be explained. Below, % means mass %.

S: 0.012 to 0.100%

S is an element required for securing the machineability of the steel and, further, is an element having an effect on the occurrence of nozzle blockage at the time of continuous casting. When the amount of S is less than 0.012%, the amount of addition of the sulfur additive need only be small and no nozzle blockage will occur. However, the required machineability cannot be secured, so the amount of S is made 0.012% or more. Preferably it is 0.015% or more.

On the other hand, when the amount of S is over 0.100%, the Ca in the ladle slag and the sulfur in the molten steel will react resulting in the production of CaS and the occurrence of nozzle blockage at the time of continuous casting. Therefore, the amount of S is made 0.100% or less. Preferably it is 0.075% or less.

Al: 0.015 to 0.100%

Al is an element which reacts with the O in the molten steel to form $Al_2O_3$ and is used for deoxidizing molten steel. When the amount of Al is less than 0.015%, the deoxidizing effect will not be sufficiently expressed, so the amount of Al is made 0.015% or more. Preferably, it is 0.025% or more. On the other hand, when the amount of Al is over 0.100%, a large amount of $Al_2O_3$ inclusions will be formed and nozzle blockage will frequently occur at the time of continuous casting, so the amount of Al is made 0.100% or less. Preferably it is 0.070% or less.

The added steel according to the present invention basically needs to contain S: 0.012 to 0.100% and further to contain Al: 0.015 to 0.100%. The composition of the other elements is not particularly limited, but to more effectively express the effect of improvement of the machineability by the addition of sulfur, the composition is controlled to C: 0.07 to 1.20%, Si: over 0 to 1.00%, Mn: over 0 to 2.50%, P: over 0 to 0.10%, N: over 0 to 0.02%. This will be explained below:

C: 0.07 to 1.20%,

C is an element required for securing the strength of steel and the hardenability of a weld zone. If the amount of C is less than 0.07%, the strength required for steel for machine structure use becomes difficult to secure, so the amount of C is 0.07% or more. More preferably, it is 0.10% or more. On the other hand, if the amount of C is over 1.20%, the toughness falls, so the amount of C is 1.20% or less. More preferably it is 1.00% or less.

Si: Over 0 to 1.00%

Si is an element which contributes to the improvement of the strength of steel by solution strengthening. If the amount of Si is over 1.00%, the toughness falls, so the amount of Si is 1.00% or less. More preferably it is 0.70% or less. The lower limit is not particularly defined, but to sufficiently obtain the effect of addition of Si, 0.01% or more is preferable. More preferable is 0.10% or more.

Mn: Over 0 to 2.50%

Mn is an element which raises the hardenability of steel and contributes to the improvement of the strength. If the amount of Mn is over 2.50%, the weldability of the steel falls, so Mn is 2.50% or less. More preferably it is 2.00% or less. The lower limit is not particularly defined, but to sufficiently obtain the effect of addition of Mn, 0.30% or more is preferable. More preferable is 0.50% or more.

P: Over 0 to 0.10%

P is an element which segregates and obstructs toughness. If the amount of P is over 0.10%, the toughness remarkably falls, so the amount of P is 0.10% or less. More preferably it is 0.05% or less. The lower limit is not particularly defined, but if reducing the amount of P to less than 0.001%, the manufacturing cost will greatly rise, so in practical steel, 0.001% is the substantive lower limit. From the viewpoint of the manufacturing cost, 0.010% or more is more preferable.

N: Over 0 to 0.02%

N is an element which contributes to improvement of the strength of steel by solution strengthening. If the amount of N is over 0.02%, the amount of solid solution N increases, the strength rises, and the toughness falls, so the amount of N is 0.02% or less. More preferably it is 0.015% or less. The lower limit is not particularly defined, but if reducing N to less than 0.001%, the manufacturing cost will greatly rise, so in practical steel, 0.001% is the substantive lower limit. From the viewpoint of the manufacturing cost, 0.002% or more is more preferable.

The added steel according to the present invention may further contain, for improving the properties, one or more elements of the groups of elements of (a) Cu: 2.00% or less and/or Ni: 2.00% or less, (b) Cr: 2.00% or less and/or Mo: 2.00% or less, (c) Nb: 0.25% or less and/or V: 0.25% or less, and (d) Ti: 0.30% or less and/or B: 0.005% or less.

(a) Group Elements Cu: 2.00 or Less Ni: 2.00% or Less

Cu and Ni are both elements contributing to improvement of the strength of steel. If the amount of Cu is over 2.00%, the strength rises too much and the toughness falls, so the amount of Cu is preferably 2.00% or less. More preferably it is 1.60% or less. The lower limit is not particularly defined, but to sufficiently obtain the effect of addition of Cu, 0.10% or more is preferable. More preferable is 0.20% or more.

If Ni is over 2.00%, in the same way as Cu, the strength rises too much and the toughness falls, so the amount of Ni is preferably 2.00% or less. More preferably it is 1.60% or less. The lower limit is not particularly defined, but to sufficiently obtain the effect of addition of Ni, 0.10% or more is preferable. More preferable is 0.30% or more.

(b) Group Elements Cr: 2.00% or Less Mo: 2.00% or Less

Cr and Mo are both elements contributing to the improvement of the strength of steel. If the amount of Cr is over 2.00%, the strength rises too much and the toughness falls, so the amount of Cr is preferably 2.00% or less. More preferable is 1.60% or less. The lower limit is not particularly defined, but to sufficiently obtain the effect of addition of Cr, 0.15% or more is preferable. More preferable is 0.25% or more.

If the amount of Mo is over 2.00%, in the same way as Cr, the strength rises too much and the toughness falls, so the amount of Mo is preferably 2.00% or less. More preferable is 1.60% or less. The lower limit is not particularly defined, but to sufficiently obtain the effect of addition of Mo, 0.02% or more is preferable. More preferable is 0.10% or more.

(c) Group Elements Nb: 0.25% or Less V: 0.25% or Less

Nb and V both are elements which form carbonitrides and contribute to the improvement of the strength and toughness by the pinning effect of the carbonitrides. If the amount of Nb is over 0.25%, the carbonitrides become coarser and the toughness falls, so the amount of Nb is preferably 0.25% or less. More preferable is 0.20% or less. The lower limit is not particularly defined, but to sufficiently obtain the effect of addition of Nb, 0.01% or more is preferable. More preferable is 0.02% or more.

If V is over 0.25%, in the same way as Nb, the carbonitrides become coarser and the HAZ (heat affected zone) toughness falls, so the amount of V is preferably 0.25% or less. More preferable is 0.20% or less. The lower limit is not particularly defined, but to sufficiently obtain the effect of addition of V, 0.01% or more is preferable. More preferable is 0.10% or more.

(d) Group Elements Ti: 0.30% or Less B: 0.005% or Less

Ti is an element which bonds with N to form nitrides and refine the crystal grains and contributes to improvement of the toughness. If the amount of Ti is over 0.30%, the machineability falls, so the amount of Ti is preferably 0.30% or less. More preferable is 0.25% or less. The lower limit is not particularly defined, but to sufficiently obtain the effect of addition of Ti, 0.01% or more is preferable. More preferable is 0.02% or more.

B is an element which inhibits the formation of intergranular ferrite and contributes to the improvement of toughness. If the amount of B is over 0.005%, BN precipitates at the austenite grain boundaries and the toughness falls, so the amount of B is preferably 0.005% or less. More preferable is 0.003% or less. The lower limit is not particularly defined, but to sufficiently obtain the effect of addition of B, 0.0005% or more is preferable. More preferable is 0.0010% or more.

EXAMPLES

Next, examples according to the present invention will be explained, but the conditions in the examples are just illustrations employed for confirming the workability and effects of the present invention. The present invention is not limited to these illustrations of conditions. The present invention can employ various conditions so long as not departing from the gist of the present invention and achieving the object of the present invention.

Example 1

When tapping molten steel primary refined in a volume 300 ton converter into a ladle, metal Al was added to deoxidize the steel by Al. In Example 1, as a sulfur additive, the brand A iron sulfide ore particles shown in FIG. 1 were used.

Table 1 shows the chemical compositions of molten steel after adding sulfur additives at the time of continuous casting of resulfurized steel of the invention examples and comparative examples.

TABLE 1

| | mass % | | | | | | | | | | | | | | | |
|---|---|---|---|---|---|---|---|---|---|---|---|---|---|---|---|---|
| No. | C | Si | Mn | P | S | N | T. Al | Cu | Ni | Cr | Mo | Nb | V | Ti | B | Iron sulfide ore brand |
| 1 | 0.07 | 0.24 | 0.48 | 0.021 | 0.023 | 0.0042 | 0.022 | | | | | | | 0.250 | | A |
| 2 | 0.45 | 0.20 | 0.80 | 0.022 | 0.025 | 0.0056 | 0.023 | | | | | | | | | A |
| 3 | 0.20 | 0.20 | 0.45 | 0.014 | 0.019 | 0.0041 | 0.025 | | | | | | | 0.130 | | A |
| 4 | 0.38 | 0.80 | 1.45 | 0.027 | 0.020 | 0.0120 | 0.025 | | | 0.15 | | 0.050 | 0.190 | | | A |
| 5 | 0.10 | 0.08 | 0.33 | 0.022 | 0.015 | 0.0050 | 0.030 | | | | | | | | | A |
| 6 | 0.40 | 0.20 | 0.80 | 0.021 | 0.022 | 0.0071 | 0.023 | | | | | | | | | A |
| 7 | 0.45 | 0.20 | 0.80 | 0.023 | 0.020 | 0.0067 | 0.023 | | | | | | | | | A |
| 8 | 0.16 | 0.25 | 0.82 | 0.016 | 0.017 | 0.0150 | 0.023 | | | 1.11 | 0.16 | | | | | A |
| 9 | 0.22 | 0.20 | 0.87 | 0.015 | 0.015 | 0.0040 | 0.028 | | | 1.23 | 0.16 | 0.020 | | | | A |
| 10 | 0.35 | 0.25 | 0.80 | 0.014 | 0.030 | 0.0054 | 0.023 | | | 0.15 | | | | | | A |
| 11 | 0.99 | 0.25 | 0.37 | 0.014 | 0.013 | 0.0070 | 0.020 | | | 1.43 | | | | | | A |
| 12 | 0.45 | 0.28 | 1.04 | 0.014 | 0.055 | 0.0120 | 0.015 | | | 0.14 | | | 0.110 | | | A |
| 13 | 0.16 | 0.26 | 1.38 | 0.021 | 0.015 | 0.0054 | 0.035 | 0.08 | 0.06 | 0.68 | 0.02 | | | | 0.0015 | A |
| 14 | 0.30 | 0.20 | 0.80 | 0.021 | 0.020 | 0.0048 | 0.023 | | | | | | | | | A |
| 15 | 0.40 | 0.22 | 0.70 | 0.016 | 0.017 | 0.0052 | 0.030 | | 1.70 | 0.80 | 0.21 | | | | | A |
| 16 | 0.16 | 0.20 | 0.45 | 0.018 | 0.016 | 0.0045 | 0.025 | | | | | | | | | A |
| 17 | 0.25 | 0.20 | 0.40 | 0.014 | 0.014 | 0.0039 | 0.025 | | | | | | | | | A |
| 18 | 0.20 | 0.23 | 0.84 | 0.021 | 0.015 | 0.0140 | 0.035 | 0.13 | 0.10 | 1.16 | 0.16 | | | | | A |
| 19 | 0.44 | 0.20 | 0.75 | 0.024 | 0.020 | 0.0067 | 0.035 | | | | | | | | | A |
| 20 | 0.20 | 0.23 | 1.20 | 0.015 | 0.025 | 0.0105 | 0.032 | | 0.12 | 1.18 | 0.06 | | | 0.020 | | A |
| 21 | 0.45 | 0.25 | 1.17 | 0.025 | 0.050 | 0.0085 | 0.020 | | | 0.22 | | | 0.095 | | | A |
| 22 | 0.35 | 0.25 | 1.36 | 0.018 | 0.020 | 0.0052 | 0.035 | | | 0.18 | 0.04 | | | | 0.0018 | A |
| 23 | 0.50 | 0.55 | 1.05 | 0.020 | 0.065 | 0.0110 | 0.035 | | | 0.18 | | | 0.090 | | | A |
| 24 | 0.45 | 0.20 | 0.85 | 0.024 | 0.047 | 0.0064 | 0.023 | | | | | | | | | A |
| 25 | 0.16 | 0.20 | 0.45 | 0.017 | 0.025 | 0.0041 | 0.025 | | | | | | | | | A |
| 26 | 0.25 | 0.20 | 0.45 | 0.024 | 0.016 | 0.0041 | 0.025 | | | 0.15 | | | | | | A |
| 27 | 0.41 | 0.25 | 1.58 | 0.021 | 0.015 | 0.0057 | 0.030 | | | 0.23 | | | | | | A |
| 28 | 0.46 | 0.25 | 1.08 | 0.014 | 0.027 | 0.0130 | 0.023 | | 0.05 | 0.18 | 0.05 | | 0.115 | | | A |
| 29 | 0.12 | 0.20 | 0.45 | 0.019 | 0.016 | 0.0040 | 0.025 | | | | | | | | | A |
| 30 | 0.30 | 0.25 | 0.92 | 0.014 | 0.045 | 0.0120 | 0.023 | | | 1.53 | 0.07 | | 0.145 | | | A |
| 31 | 0.09 | 0.07 | 0.35 | 0.017 | 0.024 | 0.0035 | 0.030 | | | | | | | | | A |
| 32 | 0.22 | 0.26 | 0.84 | 0.020 | 0.020 | 0.0055 | 0.033 | | | 1.06 | 0.36 | | | 0.040 | | A |
| 33 | 0.35 | 0.20 | 0.75 | 0.025 | 0.018 | 0.0038 | 0.023 | | | | | | | | | A |
| 34 | 0.53 | 0.20 | 0.80 | 0.021 | 0.022 | 0.0064 | 0.023 | | | | | | | | | A |
| 35 | 0.16 | 0.20 | 0.83 | 0.021 | 0.017 | 0.0150 | 0.023 | | | 1.18 | | 0.020 | | | | A |
| 36 | 0.45 | 0.25 | 0.83 | 0.021 | 0.012 | 0.0130 | 0.023 | | | 1.10 | 0.17 | | | | | A |
| 37 | 0.35 | 0.10 | 2.00 | 0.015 | 0.020 | 0.0120 | 0.023 | | | 0.45 | 0.05 | | 0.150 | | | A |
| 38 | 0.20 | 0.25 | 0.80 | 0.015 | 0.020 | 0.0055 | 0.033 | | | 1.15 | 0.16 | | | | | A |
| 39 | 0.42 | 0.20 | 1.53 | 0.017 | 0.017 | 0.0056 | 0.035 | | | 0.18 | | | | | 0.0019 | A |
| 40 | 0.45 | 0.25 | 0.95 | 0.021 | 0.030 | 0.0055 | 0.030 | | | 0.10 | | | 0.110 | | | A |
| 41 | 0.26 | 0.25 | 1.77 | 0.022 | 0.048 | 0.0130 | 0.045 | | 0.17 | 0.38 | 0.05 | | 0.190 | | | A |
| 42 | 0.53 | 0.25 | 0.76 | 0.017 | 0.026 | 0.0051 | 0.028 | | | 1.05 | 0.16 | | | | | A |
| 43 | 0.38 | 0.25 | 0.67 | 0.025 | 0.020 | 0.0050 | 0.030 | | 1.70 | 0.70 | 0.16 | | | | | A |
| 44 | 0.23 | 0.25 | 0.88 | 0.014 | 0.013 | 0.0150 | 0.023 | | 0.07 | 1.23 | 0.29 | 0.020 | | | | A |
| 45 | 0.45 | 0.20 | 0.75 | 0.022 | 0.030 | 0.0072 | 0.023 | | | | | | | | | A |
| 46 | 0.40 | 0.20 | 0.80 | 0.024 | 0.016 | 0.0042 | 0.023 | | | | | | | | | A |
| 47 | 0.20 | 0.10 | 1.85 | 0.025 | 0.055 | 0.0100 | 0.027 | | | 0.55 | | | 0.100 | | | A |
| 48 | 0.42 | 0.25 | 0.90 | 0.022 | 0.018 | 0.0052 | 0.028 | | | 1.00 | 0.16 | | | | | A |
| 49 | 0.30 | 0.25 | 0.48 | 0.021 | 0.020 | 0.0070 | 0.030 | | 2.00 | 3.00 | 0.60 | | | | | A |
| 50 | 0.50 | 0.20 | 0.87 | 0.014 | 0.020 | 0.0055 | 0.028 | | | 0.95 | 0.20 | | 0.000 | | | A |
| 51 | 0.08 | 0.05 | 0.33 | 0.018 | 0.015 | 0.0045 | 0.030 | | | | | | | | | A |
| 52 | 0.58 | 0.20 | 0.82 | 0.023 | 0.020 | 0.0067 | 0.023 | | | 0.15 | | | | | | A |
| 53 | 0.22 | 0.28 | 0.98 | 0.024 | 0.024 | 0.0110 | 0.022 | | | 1.20 | | | | | | A |
| 54 | 0.10 | 0.80 | 0.86 | 0.015 | 0.015 | 0.0032 | 0.035 | | | 0.11 | | | | | | A |
| 55 | 0.55 | 0.20 | 0.87 | 0.024 | 0.015 | 0.0071 | 0.023 | 0.13 | 0.08 | 0.16 | | | | | | A |
| 56 | 0.13 | 0.25 | 0.76 | 0.021 | 0.025 | 0.0056 | 0.035 | | | 1.06 | 0.20 | 0.020 | | | 0.0020 | A |
| 57 | 0.25 | 0.20 | 0.45 | 0.023 | 0.020 | 0.0069 | 0.025 | | | | | | | 0.030 | | A |
| 58 | 0.45 | 0.20 | 0.80 | 0.018 | 0.016 | 0.0046 | 0.023 | | | 0.15 | | | | | | A |
| 59 | 0.20 | 0.80 | 0.83 | 0.014 | 0.015 | 0.0033 | 0.035 | | | 0.10 | | | | | | A |
| 60 | 0.16 | 0.17 | 1.05 | 0.012 | 0.018 | 0.0160 | 0.025 | | 0.15 | 1.25 | 0.25 | 0.020 | | | | A |
| 61 | 0.38 | 0.20 | 0.80 | 0.026 | 0.022 | 0.0071 | 0.023 | | | | | | | | | A |
| 62 | 0.40 | 0.05 | 0.54 | 0.010 | 0.012 | 0.0035 | 0.025 | | | 0.10 | | | | | 0.0022 | A |
| 63 | 0.18 | 0.07 | 0.58 | 0.014 | 0.015 | 0.0150 | 0.023 | | 1.58 | 0.61 | 0.62 | 0.020 | | | | A |
| 64 | 0.20 | 0.25 | 0.85 | 0.019 | 0.012 | 0.0150 | 0.025 | | | 1.20 | | | | | | A |
| 65 | 0.43 | 0.25 | 1.25 | 0.026 | 0.055 | 0.0120 | 0.015 | | | 0.20 | | | 0.140 | | | A |

Note:
"T. Al" indicates total amount of Al.

After Al deoxidation, a ladle heating type refining equipment was used to adjust the temperature, then an RH vacuum degassing apparatus was used to degasify and adjust the constituents of the steel and to stir the molten steel to remove the inclusions. After the degasification and adjustment of constituents, sulfur additives containing iron sulfide ore differing in particle size were added to the molten steel. After adding the sulfur additives, the steel was stirred for the homogeneous mixing time or more to remove the inclusions.

The thus produced resulfurized steel was continuously cast. The continuous casting was carried out by a cross-sectional size 220 mm×220 mm bloom six stand casting machine.

The degree of overheating of the molten steel in the tundish at the time of continuous casting (value of temperature of molten steel minus liquidus temperature of steel of this chemical composition) was 10 to 60° C. The throughput of molten steel (amount of cast molten steel per unit time) was 0.3 to 0.6 t/min. The throughput was adjusted by the opening degree of a sliding nozzle.

Table 2 shows the mass % of iron sulfide ore having a particle size of 5.0 to 37.5 mm, the mass % of iron sulfide ore having a particle size of less than 5.0 mm, the mass % of iron sulfide ore having a particle size over 37.5 mm, the nozzle blockage index, and nozzle blockage results. Here, the "No." in Table 2 corresponds to the "No." in Table 1.

TABLE 2

| | No | Mass % of 5.0 to 37.5 mm iron sulfide ore | Mass % of less than 5.0 mm iron sulfide ore | Mass % of over 37.5 mm iron sulfide ore | Nozzle blockage index | Nozzle blockage results | Change in nozzle opening degree |
|---|---|---|---|---|---|---|---|
| Inv. ex. | 1 | 100 | 0 | 0 | 0.25 | Good | – |
| | 2 | 100 | 0 | 0 | 0.18 | Good | – |
| | 3 | 99 | 1 | 0 | 0.20 | Good | – |
| | 4 | 100 | 0 | 0 | 0.17 | Good | – |
| | 5 | 98 | 2 | 0 | 0.42 | Good | – |
| | 6 | 99 | 1 | 0 | 0.62 | Good | – |
| | 7 | 99 | 1 | 0 | 0.17 | Good | – |
| | 8 | 100 | 0 | 0 | 0.07 | Good | – |
| | 9 | 100 | 0 | 0 | 0.51 | Good | – |
| | 10 | 100 | 0 | 0 | 0.09 | Good | – |
| | 11 | 100 | 0 | 0 | 0.11 | Good | – |
| | 12 | 98 | 2 | 0 | 0.10 | Good | – |
| | 13 | 96 | 4 | 0 | 0.71 | Good | – |
| | 14 | 100 | 0 | 0 | 0.26 | Good | – |
| | 15 | 99 | 1 | 0 | 0.32 | Good | – |
| | 16 | 100 | 0 | 0 | 0.28 | Good | – |
| | 17 | 100 | 0 | 0 | 0.09 | Good | – |
| | 18 | 100 | 0 | 0 | 0.01 | Good | – |
| | 19 | 99 | 1 | 0 | 0.25 | Good | – |
| | 20 | 95 | 5 | 0 | 0.68 | Good | – |
| | 21 | 94 | 3 | 3 | 0.75 | Good | – |
| | 22 | 99 | 1 | 0 | 0.58 | Good | – |
| | 23 | 100 | 0 | 0 | 0.53 | Good | – |
| | 24 | 90 | 5 | 5 | 0.94 | Good | – |
| | 25 | 99 | 1 | 0 | 0.07 | Good | – |
| | 26 | 98 | 2 | 0 | 0.55 | Good | – |
| | 27 | 100 | 0 | 0 | 0.10 | Good | – |
| | 28 | 100 | 0 | 0 | 0.38 | Good | – |
| | 29 | 97 | 3 | 0 | 0.11 | Good | – |
| | 30 | 100 | 0 | 0 | 0.42 | Good | – |
| | 31 | 100 | 0 | 0 | 0.10 | Good | – |
| | 32 | 100 | 0 | 0 | 0.13 | Good | – |
| | 33 | 97 | 3 | 0 | 0.68 | Good | – |
| | 34 | 99 | 1 | 0 | 0.19 | Good | – |
| | 35 | 100 | 0 | 0 | 0.13 | Good | – |
| | 36 | 100 | 0 | 0 | 0.07 | Good | – |
| | 37 | 97 | 3 | 0 | 0.12 | Good | – |
| | 38 | 100 | 0 | 0 | 0.20 | Good | – |
| | 39 | 100 | 0 | 0 | 0.11 | Good | – |
| | 40 | 100 | 0 | 0 | 0.38 | Good | – |
| | 41 | 85 | 5 | 10 | 0.96 | Good | – |
| | 42 | 100 | 0 | 0 | 0.28 | Good | – |
| | 43 | 100 | 0 | 0 | 0.17 | Good | – |
| | 44 | 100 | 0 | 0 | 0.39 | Good | – |
| | 45 | 97 | 3 | 0 | 0.39 | Good | – |
| | 46 | 98 | 2 | 0 | 0.27 | Good | – |
| | 47 | 100 | 0 | 0 | 0.46 | Good | – |
| | 48 | 100 | 0 | 0 | 0.13 | Good | – |
| | 49 | 98 | 2 | 0 | 0.22 | Good | – |
| | 50 | 98 | 2 | 0 | 0.44 | Good | – |
| Comp. ex. | 51 | 60 | 5 | 35 | 2.25 | Fair | + |
| | 52 | 0 | 0 | 100 | 4.13 | Poor | + |
| | 53 | 82 | 0 | 18 | 1.58 | Fair | + |
| | 54 | 45 | 8 | 47 | 2.44 | Fair | + |
| | 55 | 80 | 20 | 0 | 1.37 | Fair | + |
| | 56 | 0 | 100 | 0 | 4.15 | Poor | + |
| | 57 | 75 | 0 | 25 | 1.81 | Fair | + |
| | 58 | 75 | 25 | 0 | 1.89 | Fair | + |
| | 59 | 15 | 0 | 85 | 3.36 | Poor | + |
| | 60 | 62 | 30 | 8 | 2.12 | Fair | + |
| | 61 | 6 | 94 | 0 | 3.55 | Poor | + |
| | 62 | 50 | 50 | 0 | 1.44 | Fair | + |
| | 63 | 50 | 6 | 44 | 2.07 | Fair | + |

TABLE 2-continued

| No | Mass % of 5.0 to 37.5 mm iron sulfide ore | Mass % of less than 5.0 mm iron sulfide ore | Mass % of over 37.5 mm iron sulfide ore | Nozzle blockage index | Nozzle blockage results | Change in nozzle opening degree |
|---|---|---|---|---|---|---|
| 64 | 31 | 69 | 0 | 1.88 | Fair | + |
| 65 | 5 | 0 | 95 | 5.01 | Poor | + |

The "nozzle blockage index" is the index of the opening degree of the sliding nozzle defined as follows: Index of the ratio of the actual opening degree of sliding nozzle and the theoretical opening degree of the sliding nozzle in the state of no nozzle blockage calculated from the throughput of the molten steel and the molten steel head (=actual opening degree/theoretical opening degree).

Here, the "theoretical opening degree" is the opening degree of the sliding nozzle required for giving a predetermined throughput in the state where the submerged nozzle and/or sliding nozzle are neither damaged or blocked. Further, the "actual opening degree" is the opening degree which a gauge of the injection system actually shows at the time of casting. If alumina clusters etc. stick to the submerged nozzle and/or sliding nozzle and blockage advances, the opening degree of the sliding nozzle is made larger in order to obtain the same flow rate. Therefore, this means that the larger the nozzle blockage index, the more frequent the nozzle blockage. The target is 1 or less.

Further, the state of nozzle blockage was evaluated also by the change with respect to the nozzle opening degree at the steady casting stage.

The "+" mark in the "Change of nozzle opening degree" in Table 2 indicates an increase in the nozzle opening degree, that is, a tendency toward nozzle blockage, while the "−" mark indicates a decrease in the nozzle opening degree, that is, a tendency toward reduction of nozzle blockage or stability of the nozzle opening degree.

The results of nozzle blockage were evaluated by three stages of the nozzle blockage index. A nozzle blockage index of 1 or less was evaluated as "Good", an index of over 1 to 3 was evaluated as "Fair", and an index of over 3 was evaluated as "Poor".

In the continuous casting of Invention Examples 1 to 50, in each case, the ratio of iron sulfide ore particles with a particle size of 5.0 to 37.5 mm in the sulfur additive was 85 mass % or more. The nozzle blockage index was 1 or less and continuous casting was possible without occurrence of nozzle blockage.

In the continuous casting of Comparative Examples 51 to 65, the ratio of iron sulfide ore particles with a particle size of 5.0 to 37.5 mm in the sulfur additive was less than 85 mass %. Nozzle blockage frequently occurred at the time of continuous casting.

Example 2

In Example 2, except for using a sulfur additive comprised of the brand B and brand C iron sulfide ore particles shown in FIG. 1, the same procedure was carried out as in Example 1 to continuously cast resulfurized steel.

Table 3 shows the chemical composition of molten steel after adding a sulfur additive at the time of continuous casting of resulfurized steel of the invention examples and comparative examples.

TABLE 3

| | mass % | | | | | | | | | | | | | | | |
|---|---|---|---|---|---|---|---|---|---|---|---|---|---|---|---|---|
| No. | C | Si | Mn | P | S | N | T. Al | Cu | Ni | Cr | Mo | Nb | V | Ti | B | Iron sulfide ore brand |
| 66 | 0.33 | 0.24 | 0.87 | 0.017 | 0.019 | 0.0039 | 0.029 | | 0.023 | 0.179 | 0.007 | 0.001 | 0.001 | 0.031 | | B |
| 67 | 0.40 | 0.23 | 1.53 | 0.015 | 0.025 | 0.0121 | 0.025 | | 0.021 | 0.194 | 0.015 | 0.001 | 0.117 | 0.001 | | B |
| 68 | 0.33 | 0.28 | 1.5 | 0.014 | 0.023 | 0.0091 | 0.034 | | 0.017 | 0.048 | 0.006 | 0.001 | 0.052 | 0.016 | | B |
| 69 | 0.49 | 0.18 | 0.7 | 0.019 | 0.027 | 0.0047 | 0.026 | | 0.019 | 0.116 | 0.008 | 0.001 | 0.002 | 0.002 | | B |
| 70 | 0.44 | 0.18 | 0.86 | 0.016 | 0.023 | 0.0044 | 0.025 | | 0.017 | 0.178 | 0.007 | 0.001 | 0.001 | 0.001 | | B |
| 71 | 0.36 | 0.27 | 0.97 | 0.015 | 0.021 | 0.0044 | 0.034 | | 0.022 | 0.121 | 0.006 | 0.002 | 0.002 | 0.034 | | B |
| 72 | 0.46 | 0.2 | 0.69 | 0.012 | 0.019 | 0.0045 | 0.024 | | 0.021 | 0.111 | 0.005 | 0.001 | 0.001 | 0.002 | | B |
| 73 | 0.36 | 0.18 | 0.73 | 0.016 | 0.02 | 0.0040 | 0.023 | | 0.021 | 0.086 | 0.006 | 0.001 | 0.001 | 0.001 | | B |
| 74 | 0.47 | 0.17 | 0.71 | 0.009 | 0.023 | 0.0050 | 0.023 | | 0.021 | 0.182 | 0.01 | 0.001 | 0.001 | 0.001 | | B |
| 75 | 0.38 | 0.31 | 0.98 | 0.017 | 0.017 | 0.0045 | 0.024 | | 0.022 | 0.97 | 0.007 | 0.001 | 0.002 | 0.032 | | B |
| 76 | 0.48 | 0.18 | 0.72 | 0.009 | 0.018 | 0.0047 | 0.025 | | 0.021 | 0.044 | 0.006 | 0.001 | 0.001 | 0.001 | | C |
| 77 | 0.32 | 0.28 | 1.5 | 0.011 | 0.021 | 0.0096 | 0.033 | | 0.025 | 0.063 | 0.007 | 0.001 | 0.055 | 0.017 | | C |
| 78 | 0.55 | 0.23 | 1.48 | 0.018 | 0.021 | 0.0049 | 0.031 | | 0.024 | 0.19 | 0.007 | 0.001 | 0.001 | 0.001 | | C |
| 79 | 0.45 | 0.22 | 1.06 | 0.022 | 0.024 | 0.0047 | 0.035 | | 0.024 | 0.099 | 0.007 | 0.001 | 0.121 | 0.002 | | C |
| 80 | 0.44 | 0.19 | 0.8 | 0.01 | 0.019 | 0.0041 | 0.025 | | 0.025 | 0.044 | 0.009 | 0.002 | 0.002 | 0.001 | | C |
| 81 | 0.33 | 0.28 | 1.48 | 0.019 | 0.022 | 0.0087 | 0.03 | | 0.022 | 0.069 | 0.01 | 0.001 | 0.05 | 0.014 | | C |
| 82 | 0.36 | 0.2 | 1.34 | 0.017 | 0.018 | 0.0047 | 0.031 | | 0.022 | 0.17 | 0.007 | 0.001 | 0.001 | 0.032 | | C |
| 83 | 0.35 | 0.18 | 1.33 | 0.019 | 0.019 | 0.0038 | 0.032 | | 0.023 | 0.168 | 0.003 | 0.001 | 0.002 | 0.033 | | C |
| 84 | 0.45 | 0.23 | 1.05 | 0.013 | 0.023 | 0.0051 | 0.034 | | 0.031 | 0.076 | 0.003 | 0.001 | 0.119 | 0.001 | | C |
| 85 | 0.38 | 0.18 | 0.75 | 0.011 | 0.021 | 0.0040 | 0.035 | | 0.022 | 0.097 | 0.006 | 0.001 | 0.001 | 0.025 | | C |

Note:
"T. Al" indicates total amount of Al.

Table 4 shows the mass % of iron sulfide ore having a particle size of 5.0 to 37.5 mm, the mass % of iron sulfide ore having a particle size of less than 5.0 mm, the mass % of iron sulfide ore having a particle size over 37.5 mm, the nozzle blockage index, and nozzle blockage results. Here, the "No." in Table 4 corresponds to the "No." in Table 3.

TABLE 4

| | No | Mass % of 5.0 to 37.5 mm iron sulfide ore | Mass % of less than 5.0 mm iron sulfide ore | Mass % of over 37.5 mm iron sulfide ore | Nozzle blockage index | Nozzle blockage results | Change in nozzle opening degree |
|---|---|---|---|---|---|---|---|
| Inv. ex. | 66 | 86 | 14 | 0 | 0.67 | Good | – |
| | 67 | 86 | 14 | 0 | 0.69 | Good | – |
| | 68 | 86 | 14 | 0 | 0.64 | Good | – |
| | 69 | 86 | 0 | 14 | 0.69 | Good | – |
| | 70 | 86 | 0 | 14 | 0.19 | Good | – |
| Comp. ex. | 71 | 50 | 30 | 20 | 3.05 | Poor | + |
| | 72 | 50 | 30 | 20 | 1.33 | Fair | + |
| | 73 | 50 | 30 | 20 | 1.26 | Fair | + |
| | 74 | 50 | 20 | 30 | 1.24 | Fair | + |
| | 75 | 50 | 20 | 30 | 1.27 | Fair | + |
| Inv. ex. | 76 | 86 | 14 | 0 | 0.59 | Good | – |
| | 77 | 86 | 14 | 0 | 0.62 | Good | – |
| | 78 | 86 | 14 | 0 | 0.69 | Good | – |
| | 79 | 86 | 0 | 14 | 0.58 | Good | – |
| | 80 | 86 | 0 | 14 | 0.68 | Good | – |
| Comp. ex. | 81 | 50 | 30 | 20 | 1.27 | Fair | + |
| | 82 | 50 | 30 | 20 | 3.11 | Poor | + |
| | 83 | 50 | 30 | 20 | 1.32 | Fair | + |
| | 84 | 50 | 20 | 30 | 2.1 | Fair | + |
| | 85 | 50 | 20 | 30 | 1.27 | Fair | + |

As will be understood from Table 4, even with the brand B and C iron sulfide ores, with a ratio of iron sulfide ore particles with a particle size in the sulfur additive of 5.0 to 37.5 mm of 85 mass % or more, the nozzle blockage index was 1 or less and continuous casting could be conducted without nozzle blockage occurring. As opposed to this, with a ratio of iron sulfide ore particles with a particle size in the sulfur additive of 5.0 to 37.5 mm of less than 85 mass %, nozzle blockage frequently occurred at the time of continuous casting.

INDUSTRIAL APPLICABILITY

As explained above, according to the method for producing according to the present invention, it is possible to provide a sulfur additive which is inexpensive and low in impurities able to stabilize the yield of sulfur in the molten steel and prevent the occurrence of nozzle blockage at the time of continuous casting. Accordingly, the present invention is high in applicability in the ferrous metal industry.

The invention claimed is:

1. A sulfur additive used for molten steel, wherein the sulfur additive contains iron sulfide ore particles having a particle size of 9.5 to 31.5 mm of 85% or more and oxygen concentration of 9 mass % or less by mass % based on the total mass % thereof.

2. A method for producing resulfurized steel comprising a sulfur adding step of adding the sulfur additive according to claim 1 to Al-deoxidized molten steel, wherein the method for producing the resulfurized steel smelts resulfurized steel comprising, by mass %, C: 0.07 to 1.20%, Si: over 0 to 1.00%, Mn: over 0 to 2.50%, N: over 0 to 0.02%

S: 0.012 to 0.100%, and

Al: 0.015 to 0.100,

P: limited to 0.10% or less, and a balance of iron and unavoidable impurities.

3. The method for producing resulfurized steel according to claim 2, wherein the resulfurized steel further contains, by mass %, one or more elements selected from Cu: 2.00% or less, Ni: 2.00% or less, Cr: 2.00% or less, Mo: 2.00% or less, Nb: 0.25% or less, V: 0.25% or less, Ti: 0.30% or less, and B: 0.005% or less.

* * * * *